US005881585A

United States Patent [19]

Kang

[11] Patent Number: 5,881,585

[45] Date of Patent: Mar. 16, 1999

[54] APPARATUS FOR SIMULTANEOUSLY UNLOCKING A DOOR LOCK AND A DEAD BOLT

[75] Inventor: Eui Shik Kang, Daegu, Rep. of Korea

[73] Assignee: Hyundae Metal Co., Ltd., Daegu, Rep. of Korea

[21] Appl. No.: 828,627

[22] Filed: Mar. 31, 1997

[51] Int. Cl.[6] ..... E05B 59/00

[52] U.S. Cl. ..... 70/107; 70/417; 70/451; 70/452; 292/21; 292/34

[58] Field of Search ..... 70/224, 107, 417, 70/118, 451, 452; 292/33–35, 336.3, 36, 37, 40, 21

[56] References Cited

U.S. PATENT DOCUMENTS

| | | | |
|---|---|---|---|
| 3,910,613 | 10/1975 | Nolin | 292/34 |
| 3,999,789 | 12/1976 | Maurits et al. | 70/107 |
| 4,012,929 | 3/1977 | Solovieff | 70/417 |
| 4,129,019 | 12/1978 | Urdal | 70/107 |
| 4,276,760 | 7/1981 | Nolin | 70/107 |
| 4,418,552 | 12/1983 | Nolin | 292/34 |
| 4,466,264 | 8/1984 | del Nero | 70/417 |
| 4,729,586 | 3/1988 | Fang . | |
| 4,809,526 | 3/1989 | Shen | 70/107 |
| 4,838,053 | 6/1989 | Shen | 292/336.3 |
| 4,979,767 | 12/1990 | Lin | 292/336.3 |
| 5,513,505 | 5/1996 | Dancs | 70/107 |
| 5,787,741 | 8/1998 | Shen | 70/417 |

*Primary Examiner*—Darnell M. Boucher
*Attorney, Agent, or Firm*—Jacobson, Price, Holman & Stern, PLLC

[57] ABSTRACT

An apparatus for simultaneously unlocking a locked dead bolt functioning as an auxiliary locking device when a lever of a cylinder door lock is turned from the interior side, in order to promptly and conveniently open a door on the inside. This is possible because an actuating body is installed on the inside for unlocking the dead bolt by rotation of a lever as well as making the lever restore.

6 Claims, 9 Drawing Sheets

APPARATUS FOR SIMULTANEOUSLY UNLOCKING A DOOR LOCK AND A DEAD BOLT

BACKGROUND OF THE INVENTION

1. Field of the Invention

The present invention relates to an apparatus for simultaneously unlocking a locked dead bolt functioning as an auxiliary locking device when a cylinder door lock's lever is turned on the inside, in order to promptly and conveniently open a door on the inside.

2. Description of the Related Art

Generally, both the cylinder door lock with a latch bolt and the dead bolt are both installed in a conventional door. This is because for security reason and the like the cylinder door lock alone is not completely sufficient for locking the door. Therefore, the dead bolt, which is superior to the door lock latch bolt in locking the door, is additionally installed so as to make the door move secure against external intrusion.

When opening the door from the interior side when the dead bolt is locked, it is required to unlock the dead bolt as well as turn the lever of the cylinder door lock. Such a dual motion causes a time delay that can be dangerous in the event of needing to promptly open the door, for instance when under a state of emergency like a fire.

SUMMARY OF THE INVENTION

Accordingly, the present invention is directed to an apparatus for simultaneously unlocking a door lock having a latch bolt and a dead bolt lock to substantially obviate one or more of the problems of the limitations and disadvantages of using dual locks.

An object of the present invention is to provide an apparatus for simultaneously unlocking a locked dead bolt when a lever of a cylinder door lock is turned from the interior side of the door, in order to promptly and conveniently open a door from the interior side.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for simultaneously unlocking a door lock and a dead bolt which are installed together in a door, comprises: a fixing plate body fixed on the interior side of the door for fixing the dead bolt and the door lock on the door, including a first aperture into which a dead bolt operating shaft is inserted; a second aperture into which an axial tube of the door lock is inserted; fixing apertures for fixing the dead bolt and the door lock with fixing bolts, an actuating body fixed on the fixing plate body with assembly screws that include a front plate having a dead bolt actuating aperture at the upper portion thereof, and a lever inserting aperture at the lower portion thereof; a back plate having a dead bolt actuating aperture and a lever inserting aperture which correspond to the dead bolt actuating aperture and the lever inserting aperture of the front plate, with ascent/descent guiding projections located generally on the lengthwise center thereof, two spring fixing projections and a rotation limit projection located on the periphery of the lever inserting aperture, and a dead bolt actuating member having an actuating wing piece inserted into the dead bolt actuating aperture inside the actuating body; an ascent/descent plate having an actuating groove located at the upper portion thereof for operating the dead bolt actuating member, and guiding apertures where the ascent/descent guiding projections of the back plate are inserted in order to guide an ascent/descent movement; and a rotatable plate body having ascent/descent projections for operating the ascent/descent plate in order to have it ascent/descent, and a restorable spring fitted thereto to perform a rotational return movement of the rotatable plate by an exerted elastic rotational force or torsional force produced by the spring; and a cover for covering the actuating body that includes a dead bolt actuating lever located at the upper portion thereof, and a lever passing aperture located at the lower portion thereof, wherein a lever is inserted into the lever passing aperture.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Figure 1:
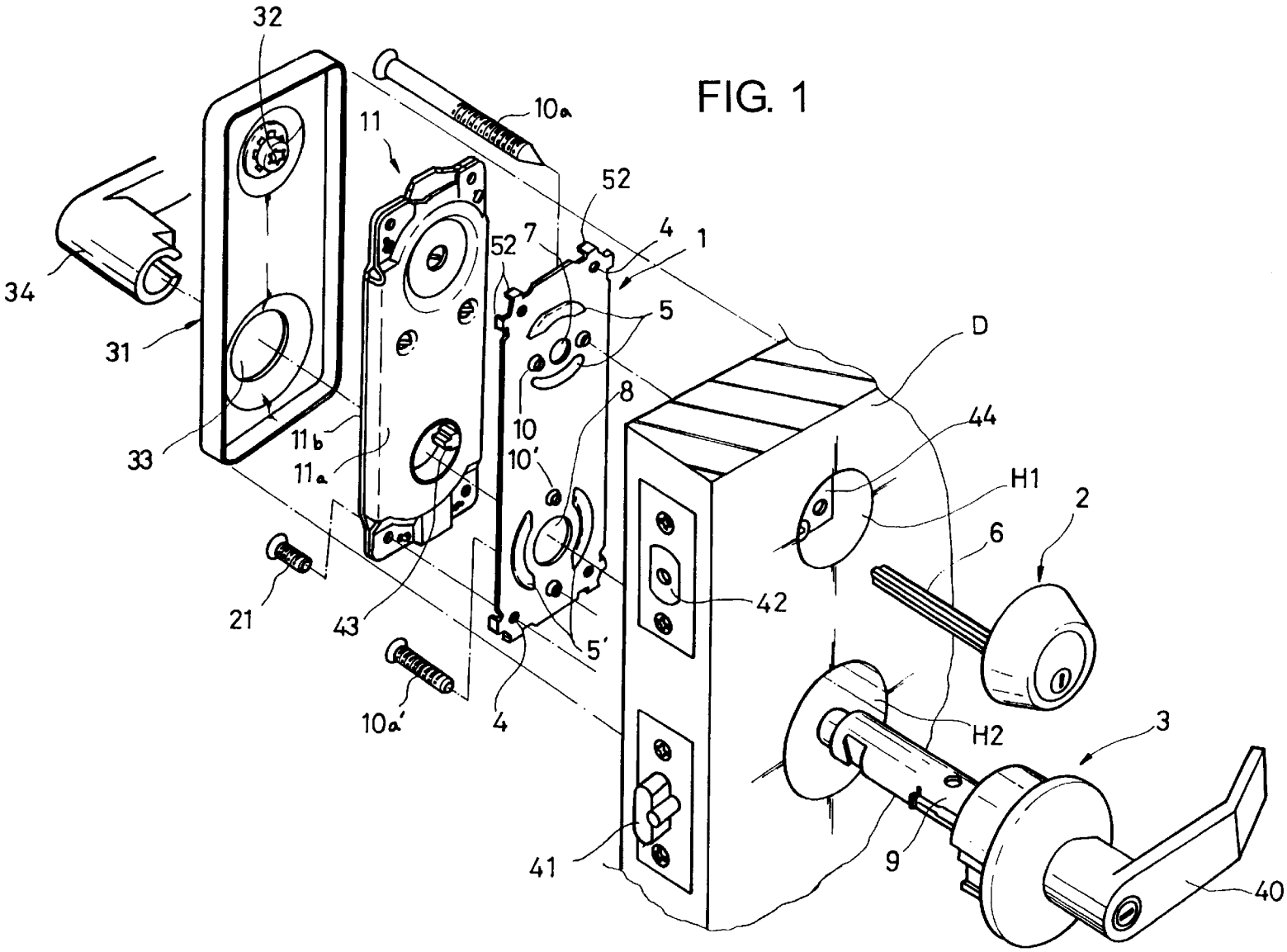
FIG. 1 is an exploded perspective view of one embodiment of an apparatus in accordance with the present invention.
Figure 2:
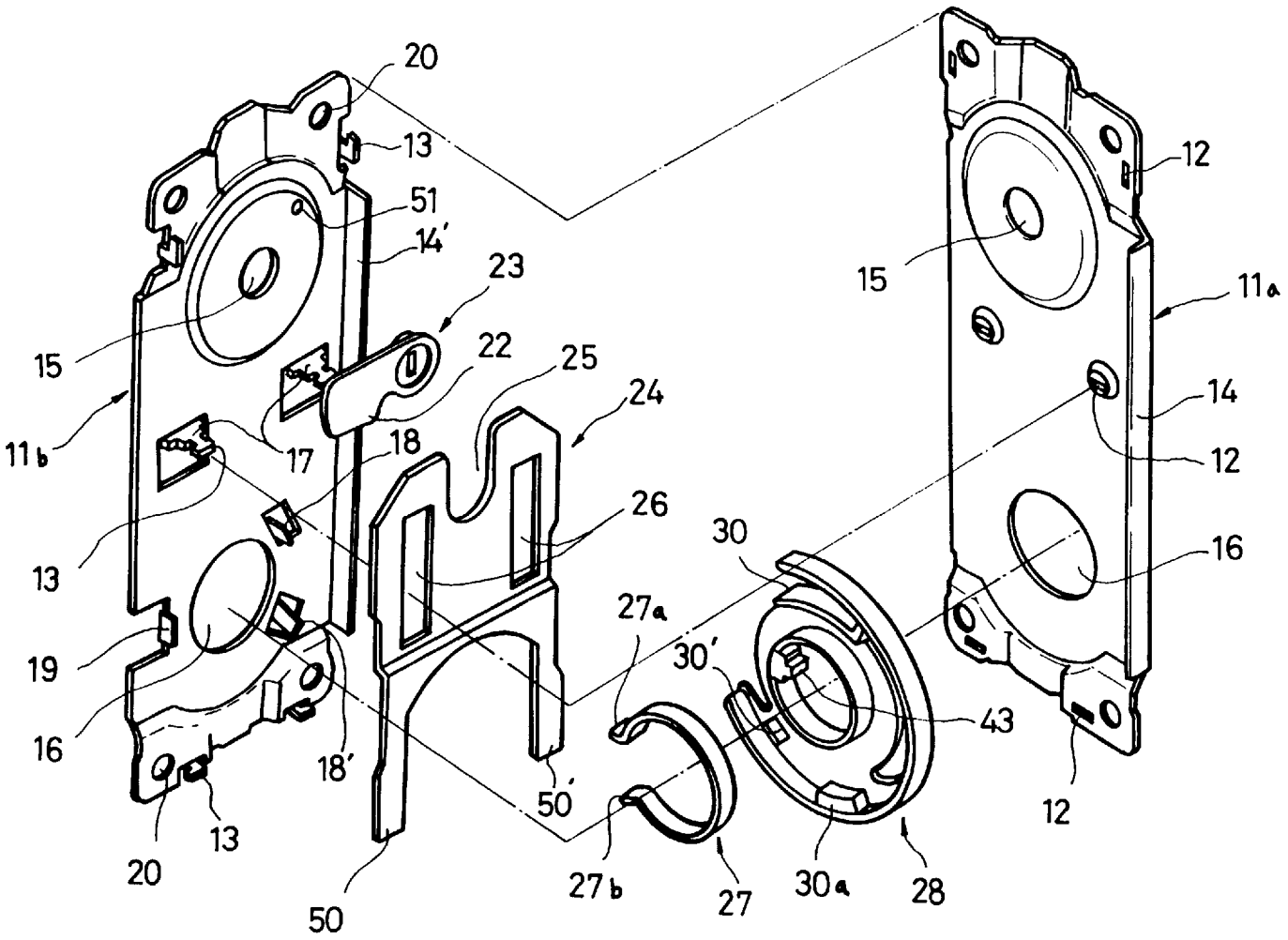
FIG. 2 is an exploded perspective view of a main portion of the present invention.
Figure 3:
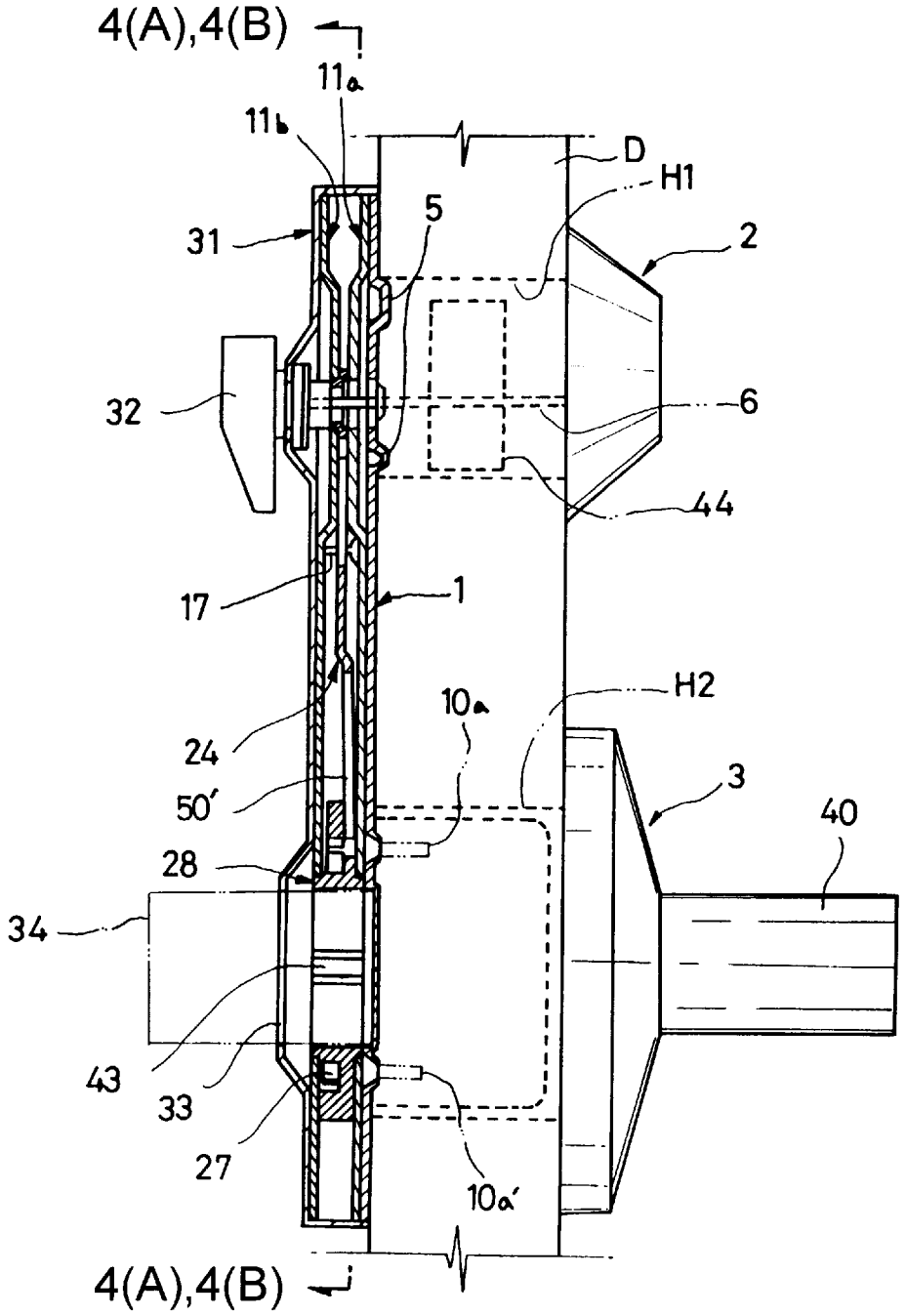
FIG. 3 is a cross-sectional view of the present invention shown in FIGS. 1 and 2.

Reference will now be made in detail to the preferred embodiments of the present invention, examples of which are illustrated in the accompanying drawings.

The fixing plate body 1, which covers a dead bolt fixing aperture H1 and a door lock fixing aperture H2 simultaneously, is fixed on the interior side of a door D in order to affix a dead bolt lock 2 and a door lock 3 on the door D.

The fixing plate body 1 includes respective assembly apertures 4 located on its four corners; upper mounting projections 5 to be inserted into the dead bolt fixing aperture H1 and lower mounting projections 5' to be inserted into the door lock fixing aperture H2; a pair of contact projections 52 located at its four corners, the corners of the fixing plate body 1 being slightly bent in order to prevent an assembly screw 21 from unfastening, in the event that the fixing plate body 1 connects with the actuating body 11; an aperture 7 into which a dead bolt operating shaft 6 is inserted; an aperture 8 into which an axial tube 9 of the door lock 3 is inserted; and fixing apertures 10 and 10' for fixing the dead bolt 2 and the door lock 3 with fixing bolts 10*a* and 10*a*', respectively.

The actuating body 11 whose front plate 11*a* and back plate 11*b* connect with each other and have bent side portions 14 and 14' located at the sides thereof, respectively, for space therein, includes a dead bolt actuating aperture 15 at the upper portion thereof, a lever inserting aperture 16 at the lower portion thereof and assembly apertures 20 located at the corners of the front and the back plates 11*a* and 11*b* thereof, for fixing it on the fixing plate body 1 with the assembly screw 21. A part of the back plate 11*b* erected forms connecting projections 13. The connecting projections 13 are inserted into connecting apertures 12 formed on the front plate 11*a*, and the portion of the connecting projections 13 extending out through the connecting apertures 12 are twisted to be fixed. As a result, the front plate 11*a* and back plate 11*b* are connected to each other.

The back plate 11*b* of the actuating body 11 comprises a stop projection 51 located to a side of the dead bolt actuating aperture 15; ascent/descent guiding projections 17 located on both sides of the center thereof; and two spring fixing projections 18 and 18' and a rotation limit projection 19 located around the lever inserting aperture 16. A part of the back plate 11*b* is bent and projected to form the ascent/descent guiding projections 17, and a connecting projection 13 is integrally formed at the end of each ascent/descent guiding projections 17.

A dead bolt actuating member 23 having an actuating wing piece 22 is inserted into the dead bolt actuating aperture 15 inside the actuating body 11. And an ascent/descent plate 24 is inserted into the lower portion of the actuating body 11. The ascent/descent plate 24 includes an actuating groove 25, guiding apertures 26 located on both sides thereof for receiving the ascent/descent guiding projections 17, and actuating legs 50 and 50' located at the lower portion thereof. The ascent/descent guiding projections 17 of the back plate 11*b* are inserted into the guiding apertures 26. The guiding apertures 26 extend lengthwise with a width that matches with the ascent/descent guiding projections' 17 when the plate 11*a* and 11*b* are connected.

A restorable spring 27 and a rotatable plate body 28 are installed at the lever inserting aperture 16 inside the actuating body 11. The rotatable plate body 28 includes ascent/descent projections 29 and 29' located at the front on both transverse sides thereof, and two spring fitting projections 30 and 30' and a stopping protrusion 30*a* located at the opposite side thereof in order for bent portions 27*a* and 27*b* of the restorable spring to be simultaneously fitted to both the spring fixing projections 18 and 18' of the back plate 11*b* and the spring fitting projections 30 and 30'.

The cover 31 for covering the actuating body 11 includes a dead bolt actuating lever 32 located at the upper portion thereof, and a lever passing aperture 33 located at the lower portion thereof. A lever 34 is inserted into the lever passing aperture 33.

Figure 6:
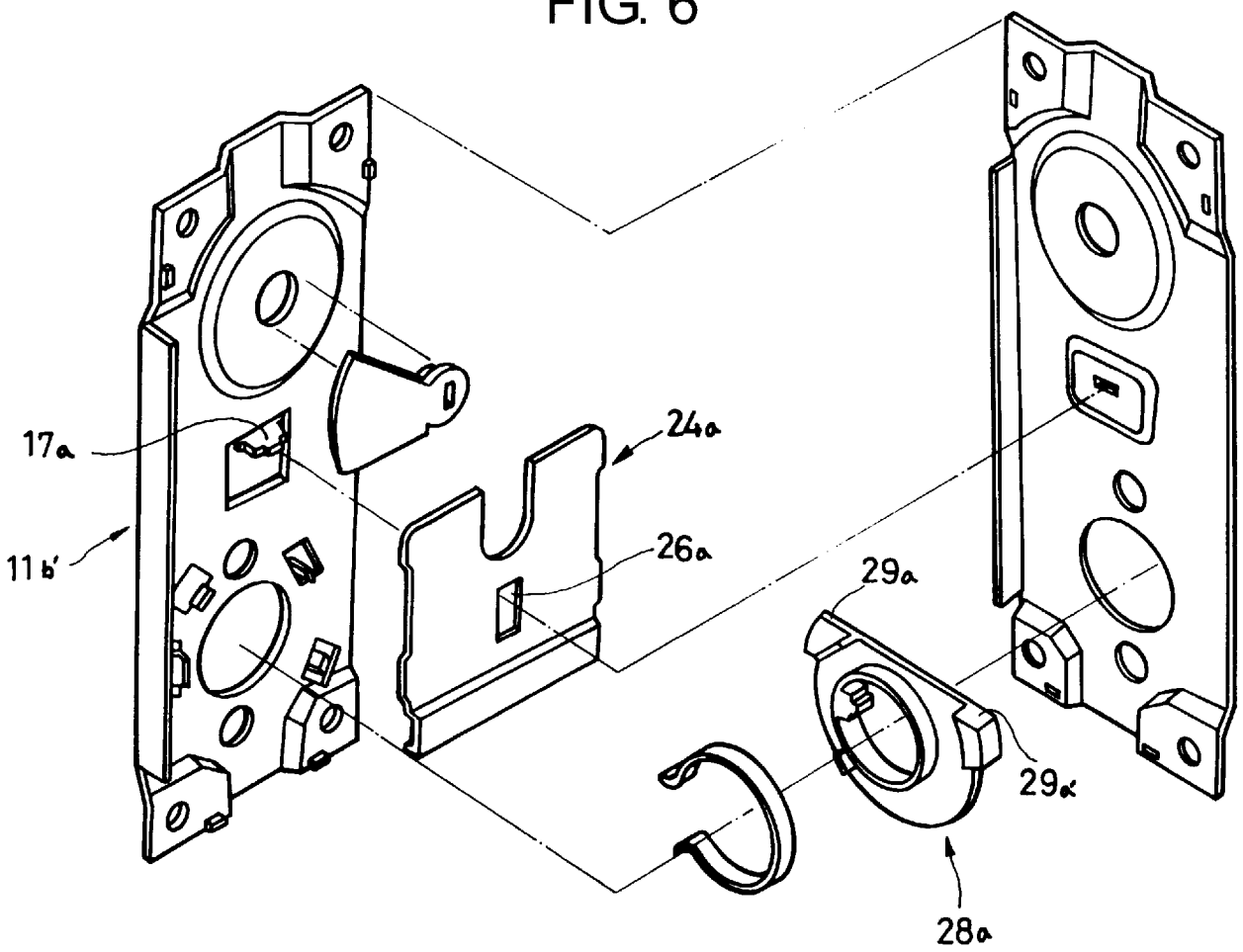
FIG. 6 is an exploded perspective view of another preferred embodiment of the present invention.
Figure 7A:
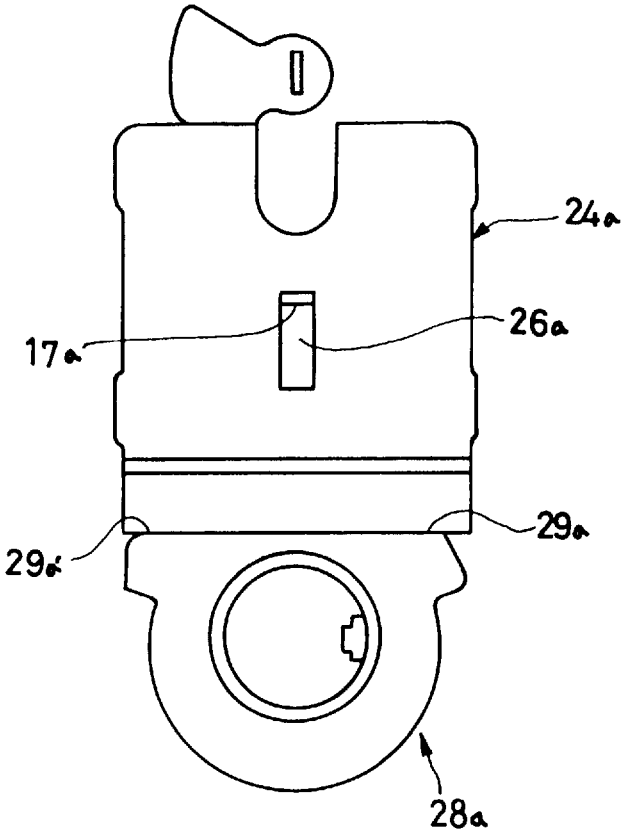
FIG. 7A is a schematic diagram of FIG. 6 in which the door lock and the dead bolt of the present invention is in the locked position.
Figure 7B:
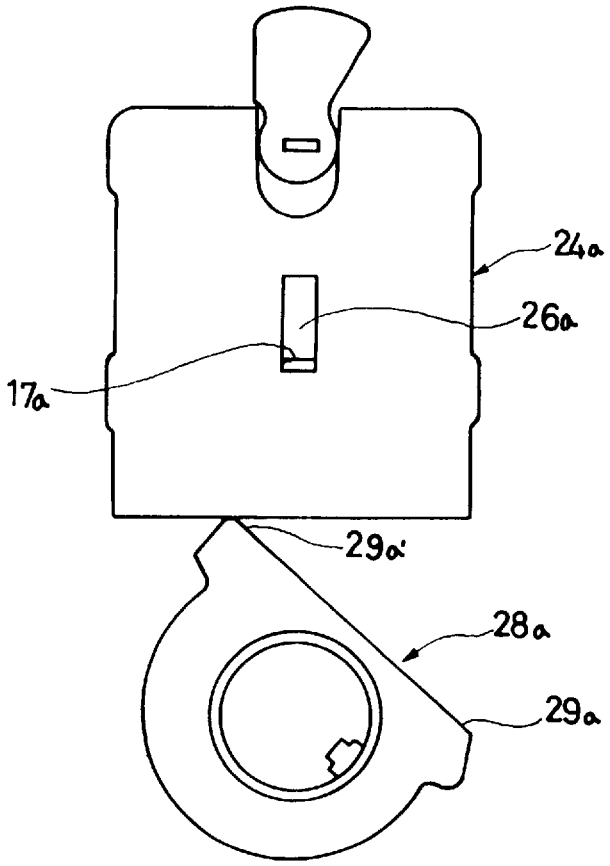
FIG. 7B is schematic diagram of FIG. 6, in which the apparatus for simultaneously unlocking the door lock and the dead bolt of the present invention is unlocked.

FIGS. 6 and 7 are a perspective view and a schematic diagram of another embodiment of the present invention, respectively.

Ascent/descent projections 29*a* and 29*a*' are formed at the upper portion of a rotation actuating body 28*a*, and bottom of an ascent/descent plate 24*a* has no actuating legs so that it directly contacts the ascent/descent projections 29*a* and 29*a*', and is then forcibly pushed up thereby. The ascent/descent plate 24*a* includes a guiding aperture 26*a* located on the center thereof, and a back plate 11*b*' includes an ascent/descent guiding projection 17*a* located on the center thereof.

The symbols not explained in the drawings are as follows;

40—an external lever of a door lock

41—a latch bolt

42—a dead bolt locking shaft

43—a lever hanging projection

44—a dead bolt latch

Figure 4A:
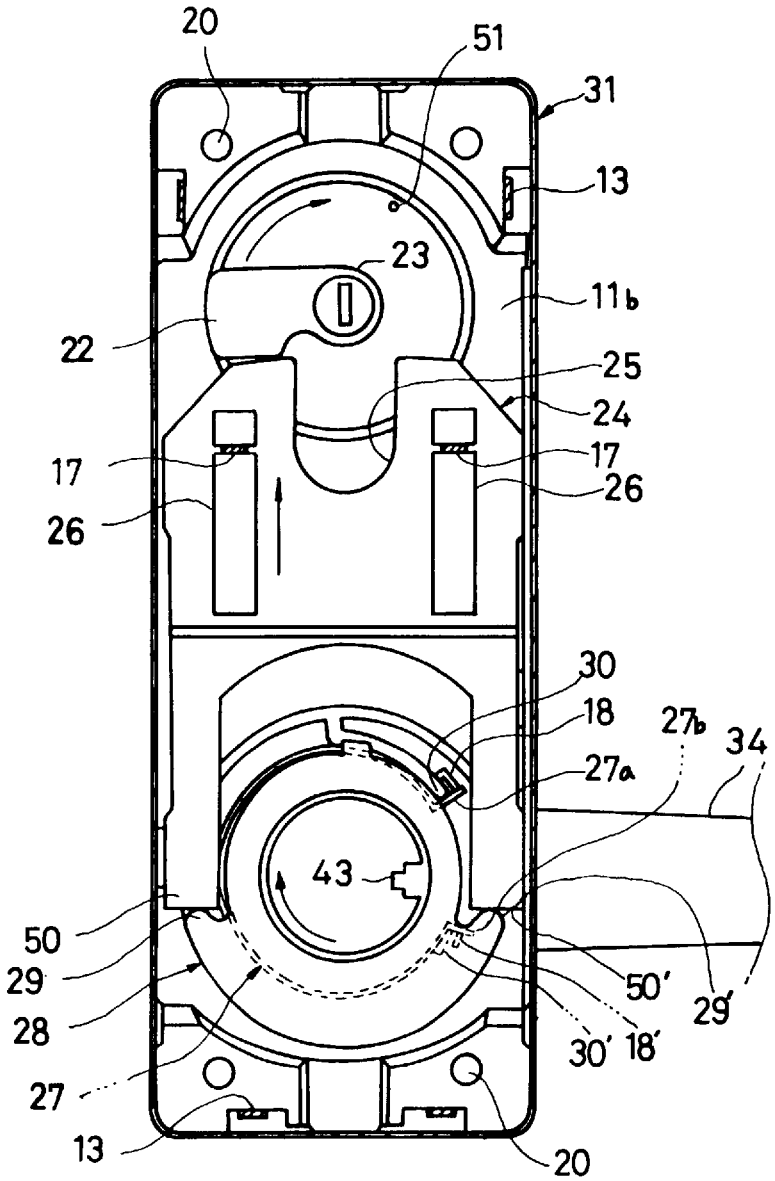
FIG. 4A is a cross-sectional view taken along the sectional line A—A of FIG. 3 showing the door lock and the dead bolt of the present invention in the locked position.
Figure 4B:
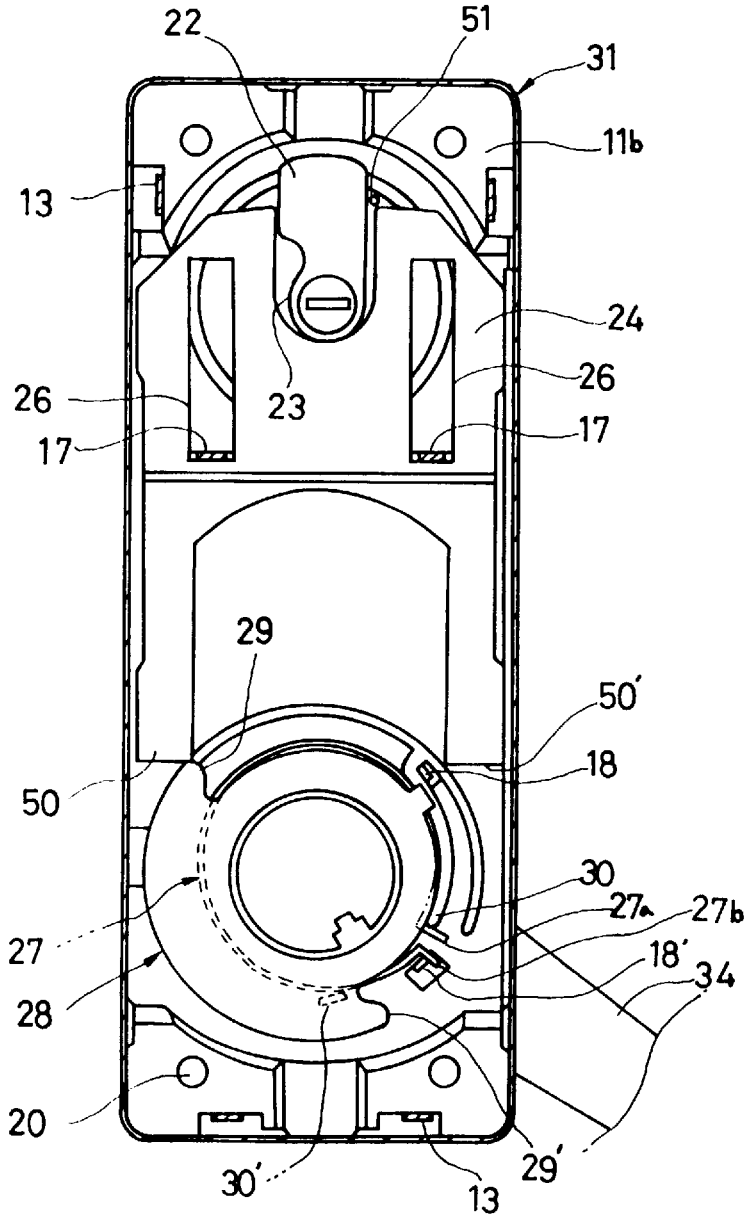
FIG. 4B is also a cross-sectional view taken along the line A—A of FIG. 3 showing the door lock and the dead bolt of the present invention in the unlocked position.
Figure 5:
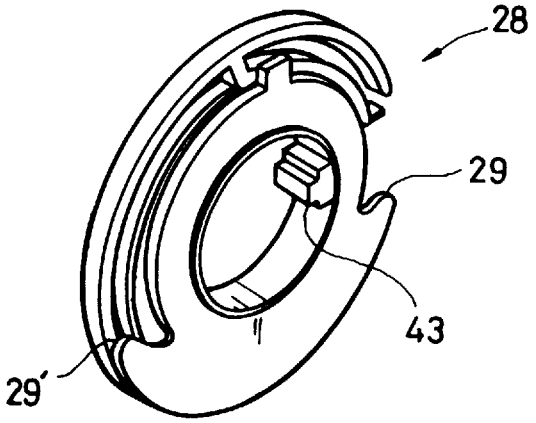
FIG. 5 is a perspective view of the rotatable plate body of the present invention.

The following description relates to the operation of the first and second embodiments of the present invention, referring to FIG. 4, but the operation is generally similar for the second embodiment, referring to FIG. 7.

When the dead bolt actuating lever 32 is rotated on the interior side of the door D, or the dead bolt 2 is made to be locked by a key on the outside, an internal structure of the actuating body 11 is like as shown in FIG. 4A.

In this position, when the lever 34 is turned on the interior side of the door D, the lever rotates the rotatable plate body 28 inside the actuating body 11. Accordingly, the ascent/descent projections 29 and 29' located at both sides of the rotatable plate body 28 push up the actuating legs 50 and 50' located at the lower portion of the ascent/descent plate 24 so that the ascent/descent plate 24 rises, while being supported by the ascent/descent guiding projections 17, the guiding apertures 26, and the bent portions 14 and 14'.

The upper portion of the rising ascent/descent plate 24 pushes up the actuating wing piece 22 of the dead bolt actuating member 23, and then the dead bolt actuating member 23 is rotated. As the dead bolt operating shaft 6 is rotated, the dead bolt 2 becomes unlocked.

Accordingly, the dead bolt 2 is simultaneously unlocked by an operation of the lever 34 of the door lock 3. Thus, you can open the door at a time, even if the dead bolt 2 is locked.

Furthermore, the upper portion of the rising ascent/descent plate 24 is stopped at a fixed height by means of the stop projection 51 of the back plate 11*b* in order to primarily restrict the excessive operation of the lever 34.

In addition, when the lever 34 is rotated, the ascent/descent plate 24 rises, and the restorable spring 27 also operates while unlocking the door. When the rotatable plate body 28 is rotated, one spring fitting projection 30 thereof on which one bent portion 27*a* of the restorable spring 27 is fitted, operates, while the other bent portion 27*b* of the restorable spring 27 is fixed by being fitted in the spring fixing projection 18'. As a result, the restorable spring 27 has an elastic force, and this acts on the restoration and level sustenance of the lever 34.

Referring to FIGS. 6 and 7 of the preferred embodiments of the present invention, the ascent/descent plate 24*a* has no actuating legs because the ascent/descent projections 29*a* and 29*a*' are formed at the upper portion of the rotation actuating body 28*a*, and only one guiding aperture 26*a* and one ascent/descent guiding projection 17*a* are formed at the ascent/descent plate 24*a* and the back plate 11*b*', respectively. Therefore, the present invention with such a simpler structure operates equally as well as the first described preferred embodiment.

As mentioned above, operating of the door lock 3 forces operation of the dead bolt 2, and the actuating body 11 that restores the lever 34 is installed on the interior side of the door D. As a result, the dead bolt is simultaneously unlocked by the operation of the lever 34 in one step so that the door is opened promptly and conveniently.

It will be apparent to those skilled in the art that various modifications and variations can be made in an apparatus for simultaneously unlocking a door lock and a dead bolt of the present invention without departing from the spirit or scope of the invention. Thus, it is intended that the present invention includes and covers the modifications and variations of this invention provided they come within the scope of the appended claims and their equivalents.

What is claimed is:

1. An apparatus for simultaneously unlocking a door lock and a dead bolt that are both installed in a door, comprising:

a fixing plate body adapted to be fixed on an interior side of the door for fixing the dead bolt and the door lock to the door, said fixing plate body including a first aperture adapted for a dead bolt operating shaft to be inserted, a second aperture adapted for an axial tube of the door lock to be inserted, and fixing apertures adapted for fixing the dead bolt and the door lock to the door with fixing bolts;

an actuating body fixed onto said fixing plate body with at least one assembly screw, said actuating body including a front plate having a dead bolt actuating aperture at the upper lengthwise portion thereof and a lever inserting aperture at the lower portion thereof, a back plate having a dead bolt actuating aperture and a lever inserting aperture which correspond to the dead bolt actuating aperture and the lever inserting aperture of said front plate, respectively, said dead bolt actuating apertures of said front and said back plate adapted to receive the dead bolt operating shaft and said lever inserting aperture of said front and back plate adapted to receive the axial tube of the door lock, said back plate having at least one ascent/descent guiding projection located between said dead bolt activating aperture and said lever inserting aperture of said back plate, said back plate having two spring fixing projections and a rotation limit projection located around a periphery of the lever inserting aperture, a dead bolt actuating member with an actuating wing piece which is inserted into the dead bolt actuating apertures inside the actuating body and is adapted to rotate the dead bolt operating shaft to unlock the dead bolt by rotating within said dead bolt actuating apertures; said actuating body further including an ascent/descent plate with an actuating groove located at an upper portion thereof for contacting and rotating the dead bolt actuating member, said ascent/descent plate having at least one guiding aperture to receive each ascent/descent guiding projection on said back plate to guide an ascent/descent movement of said ascent/descent plate, a rotatable plate body having ascent/descent projections for contacting and operating said ascent/descent plate in order to make it ascent/descent and operate said dead bolt actuating member, and a restorable spring fitted to said rotatable body and said spring fixing projections adapted to perform a rotational movement of said rotatable plate by an exerted elastic rotational return force and restore a turn lever to a generally horizontal position;

and a cover for covering the actuating body including a dead bolt actuating lever located at the upper lengthwise portion thereof and adapted to operate the dead bolt, a lever passing aperture located at the lower lengthwise portion thereof to receive the turn lever, and said lever is adapted to connect with the axial tube of the door lock to operate the door lock and to connect with the rotatable plate body to operate the dead bolt.

2. The apparatus as claimed in claim 1, wherein said fixing plate body is rectangular in shape adapted to cover a dead bolt fixing aperture and a door lock fixing aperture simultaneously, said fixing plate body including a first mounting projection located around said first aperture and adapted to be inserted into the dead bolt fixing aperture, a second mounting projection located around the second aperture and adapted to be inserted into the door lock fixing aperture, and four pairs of contact projections located at four corners of said fixing plate body for enhancing a connection between the fixing plate body and the actuating body.

3. The apparatus as claimed in claim 1, wherein said front plate and said back plate of said actuating body are connected with each other by means of connecting apertures and connecting projections, said plates having bent side portions located at their lateral sides for attaining a space between said front and back plates in which operating parts of said actuating body adapted for unlocking the dead bolt and restoring said turn lever are installed, and at least one of said connecting projections are located at the end of said guiding projection.

4. The apparatus as claimed in claim 1, wherein a stop projection is formed on one side of the dead bolt actuating aperture on said back plate to restrict excessive rising of said ascent/descent plate, said dead bolt actuating aperture being formed at a location to where the ascent/descent plate rises up.

5. The apparatus as claimed in claim 1, wherein said at least one ascent/descent guiding projection is a pair on the back plate, and said at least one guiding aperture is a pair on the ascent/descent plate to correspond to the ascent/descent guiding projections which are inserted into them, actuating legs are protruded downwards from a lower portion of said ascent/descent plate, the rotatable plate body is in the form of a round plate, the ascent/descent projections are located at both front transverse sides of the rotatable plate body for contact with the actuating legs and operating the ascent/descent plate, and two spring fitting projections are formed on said rotatable plate body in order for bent portions of said restorable spring to be simultaneously fitted to both the spring fixing projections of the back plate and the spring fitting projections of said rotatable plate body.

6. The apparatus as claimed in claim 1, wherein one ascent/descent guiding projection is formed on the back plate and one guiding aperture is formed on the center of the ascent/descent plate which corresponds to the ascent/descent guiding projection which is inserted into it, the ascent/descent plate has a generally flat lower portion, the rotatable plate body is in the form of a hemicyclic plate with a round portion directed downward, and said ascent/descent projections are located at the upper lateral sides of the rotatable plate body for operating said ascent/descent plate by contact with the flat lower portion of said ascent/descent plate.

* * * * *